US009872806B2

(12) United States Patent
Lo

(10) Patent No.: US 9,872,806 B2
(45) Date of Patent: Jan. 23, 2018

(54) BED FOR PATIENT

(71) Applicant: DK City Corporation, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 87 days.

(21) Appl. No.: 15/004,988

(22) Filed: Jan. 24, 2016

(65) Prior Publication Data

US 2017/0209320 A1 Jul. 27, 2017

(51) Int. Cl.

| | |
|---|---|
| ***A47B 7/02*** | (2006.01) |
| ***A61G 7/015*** | (2006.01) |
| ***A61G 7/018*** | (2006.01) |
| *A61G 7/005* | (2006.01) |
| *A47C 19/02* | (2006.01) |
| *A61G 7/002* | (2006.01) |
| *A47C 19/04* | (2006.01) |

(52) U.S. Cl.

CPC ..... *A61G 7/015* (2013.01); *A61G 7/018* (2013.01); *A47C 19/02* (2013.01); *A47C 19/04* (2013.01); *A61G 7/002* (2013.01); *A61G 7/005* (2013.01)

(58) Field of Classification Search

CPC ..... A61G 7/015; A61G 7/018; A61G 7/002; A61G 7/005; A47C 19/04; A47C 19/045; A47C 19/02

See application file for complete search history.

(56) References Cited

U.S. PATENT DOCUMENTS

| | | | | |
|---|---|---|---|---|
| 3,608,102 | A * | 9/1971 | Goodman | A61G 7/002 5/611 |
| 3,898,702 | A * | 8/1975 | Goodman | A61G 7/015 5/618 |
| 5,479,665 | A * | 1/1996 | Cassidy | A61G 7/001 5/609 |
| 6,668,408 | B2 * | 12/2003 | Ferrand | A61G 7/00 5/710 |
| RE43,193 | E * | 2/2012 | Osborne | A47C 19/045 5/600 |
| 9,381,125 | B2 * | 7/2016 | Herbst | A61G 7/1067 |
| 2001/0032362 | A1 * | 10/2001 | Welling | A61G 7/0528 5/600 |
| 2005/0172405 | A1 * | 8/2005 | Menkedick | A61B 5/1115 5/618 |

* cited by examiner

*Primary Examiner* — David E Sosnowski
*Assistant Examiner* — Morgan J McClure

(57) ABSTRACT

A bed includes a base, a mattress-supporting device, two driving units and a limiting unit. The base includes two tracks. The mattress-supporting device includes a frame, a body-supporting element and a leg-supporting element. The frame includes rollers supported on the tracks. The body-supporting element is pivotally connected to an end of the frame. The leg-supporting element is pivotally connected to another end of the frame. The first driving unit is operable for pivoting the body-supporting element. The second driving unit is operable for pivoting the leg-supporting element. The limiting unit is movable between a first position to allow horizontal movement of the mattress-supporting device on the base as the body-supporting element is pivoted and a second position to avoid horizontal movement of the mattress-supporting device on the base as the body-supporting element is pivoted.

7 Claims, 10 Drawing Sheets

BED FOR PATIENT

BACKGROUND OF INVENTION

1. Field of Invention

The present invention relates to medical care and, more particularly, to a bed for a patient.

2. Related Prior Art

Patients who suffer serious injuries or diseases spend a lot of time in beds. A bed for use at home is not useful for helping a patient sit when eating, drinking or reading.

A typical bed for use in a hospital is equipped with a mechanism that includes a crank operable to raise a portion of the bed that supports a patient's body. Hence, the patient's body is raised. However, there are at least two problems with the use of this bed. Firstly, when the portion of the bed is raised, the patient's body tends to slide down the portion of the bed, i.e., the patient's body is not adequately supported by the portion of the bed. Secondly, when the portion of the bed is raised, it is moved away from a bedside cabinet on or in which food, water, medicine or a book is placed, to the disadvantage of the patient who would like to get the food, water, medicine or book.

Taiwanese Patent M473750 discloses a bed that is equipped with a mechanism for synchronously raising a portion of the bed and horizontally moving the portion of the bed. Thus, when the portion of the bed is raised, it is kept close to a bedside cabinet on or in which food, water, medicine or a book is placed. However, when the portion of the bed is raised, the patient's body tends to slide down the portion of the bed. That is, the patient's body is not adequately supported by the portion of the bed.

Taiwanese Patent M507223 discloses a bed that is equipped with a mechanism for synchronously raising two portions of the bed. The first portion of the bed supports a patient's body and the second portion of the bed supports the patient's upper legs. Thus, the tendency of the patient's body to slide down the first portion of the bed is offset by the tendency of the patient's legs to slide down the second portion of the bed. However, when the first portion of the bed is raised, it is moved away from a bedside cabinet on or in which food, water, medicine or a book is placed, to the disadvantage of the patient who would like to get the food, water, medicine or book.

The present invention is therefore intended to obviate or at least alleviate the problems encountered in prior art.

SUMMARY OF INVENTION

It is the primary objective of the present invention to provide an effective and convenient bed for a patient.

To achieve the foregoing objective, the bed includes a base, a mattress-supporting device, two driving units and a limiting unit. The base includes two tracks. The mattress-supporting device includes a frame, a body-supporting element and a leg-supporting element. The frame includes rollers supported on the tracks. The body-supporting element is pivotally connected to an end of the frame. The leg-supporting element is pivotally connected to another end of the frame. The first driving unit is operable for pivoting the body-supporting element. The second driving unit is operable for pivoting the leg-supporting element. The limiting unit is movable between a first position to allow horizontal movement of the mattress-supporting device on the base as the body-supporting element is pivoted and a second position to avoid horizontal movement of the mattress-supporting device on the base as the body-supporting element is pivoted.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DESCRIPTION OF PREFERRED EMBODIMENT

Figure 1:
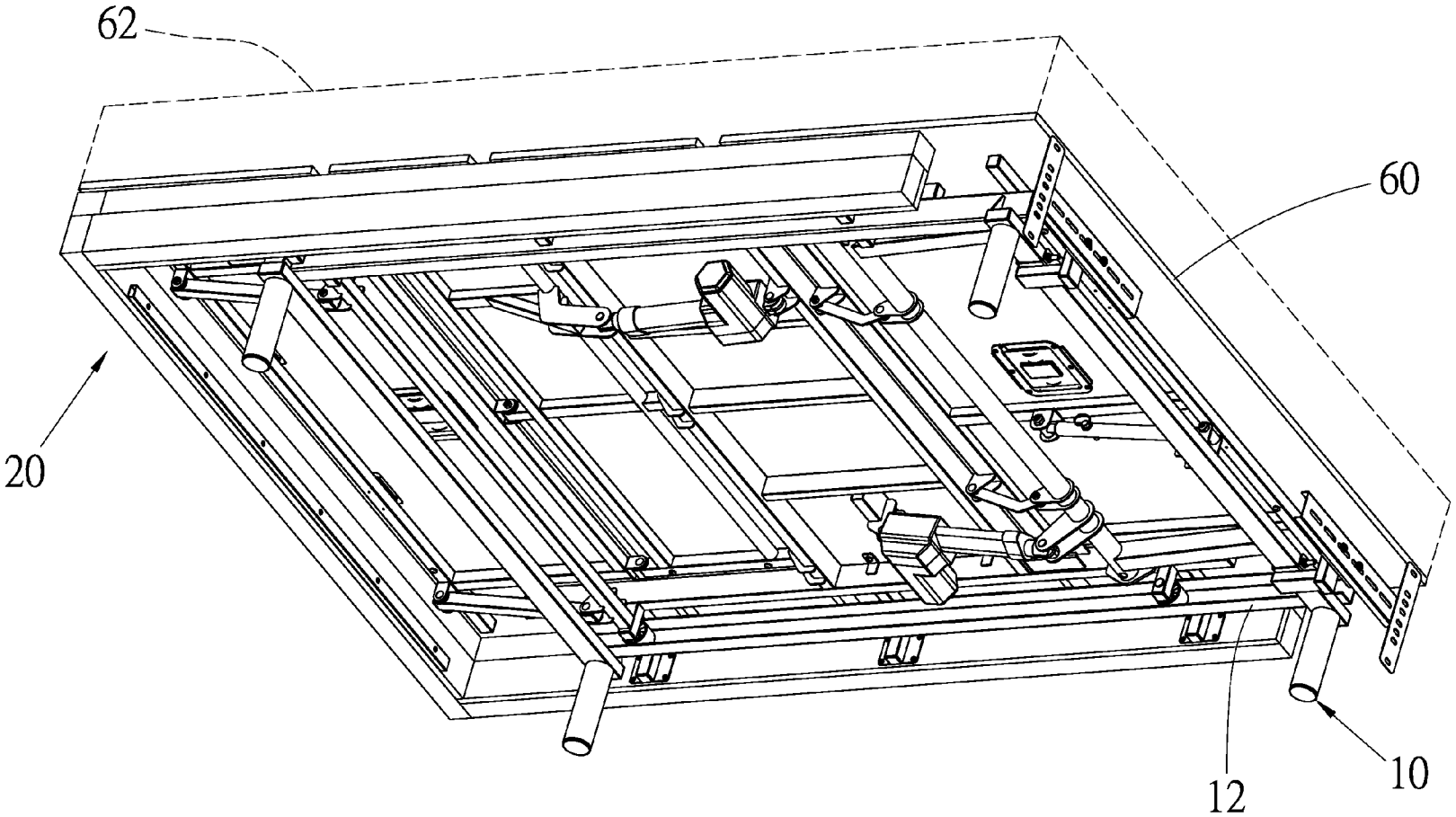
FIG. 1 is a perspective view of a bed in accordance with the preferred embodiment of the present invention, with a mattress shown in phantom lines.

Referring to FIG. 1, a mattress 62 is supported on a bed according to the preferred embodiment of the present invention. The bed includes a base 10, a mattress-supporting device 20, a first driving unit and several boards 60. The base 10 includes two tracks 12, two crossbars (not numbered) and four posts (not numbered). The crossbars are supported on the posts. The tracks 12 are supported on the crossbars. The mattress-supporting device 20 is movably supported on the tracks 12, which extend parallel to each other. The boards 60 are supported on the mattress-supporting device 20. The mattress 62 is supported on the boards 60.

Figure 2:
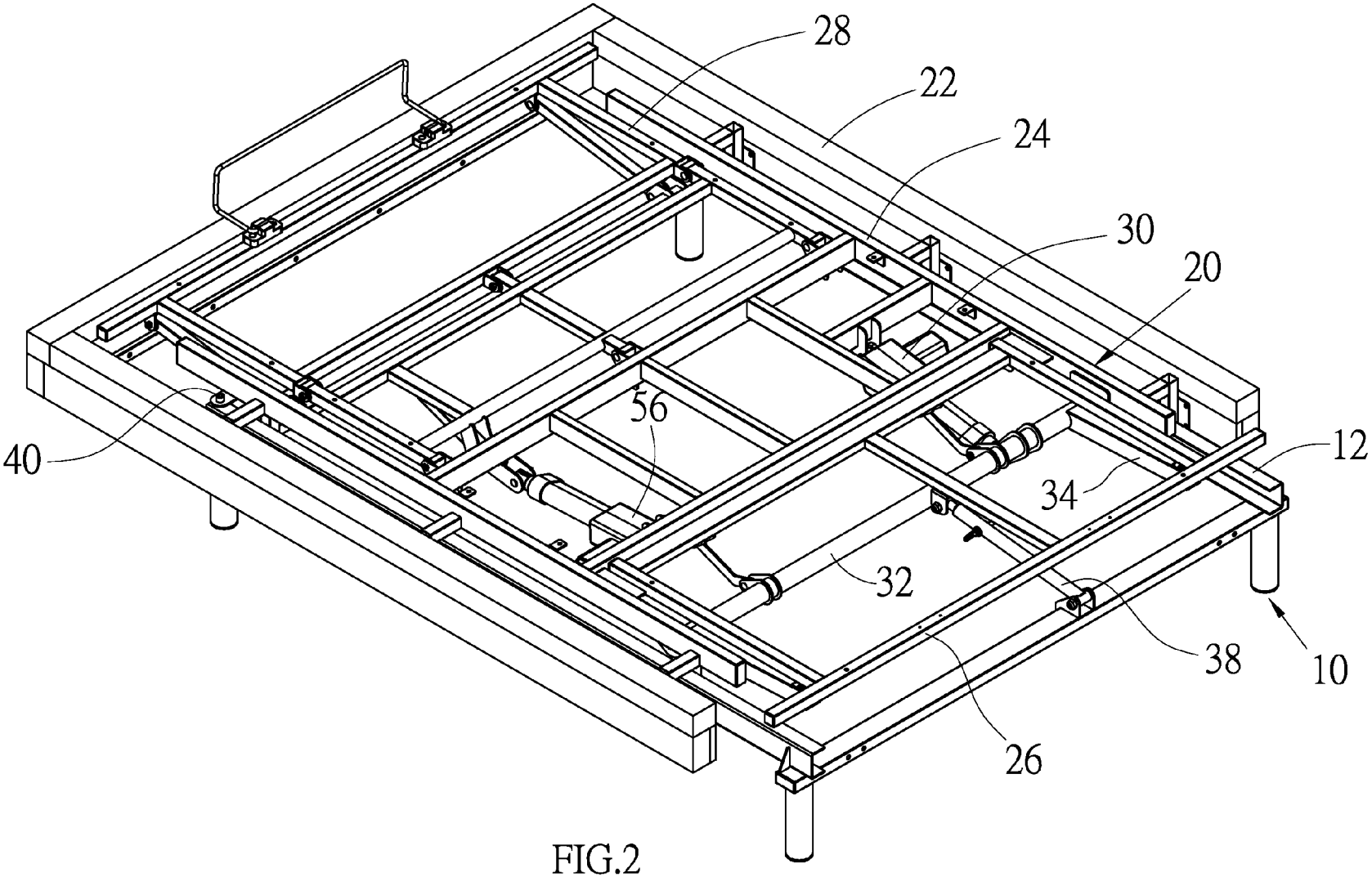
FIG. 2 is another perspective view of the bed shown in FIG. 1.
Figure 3:
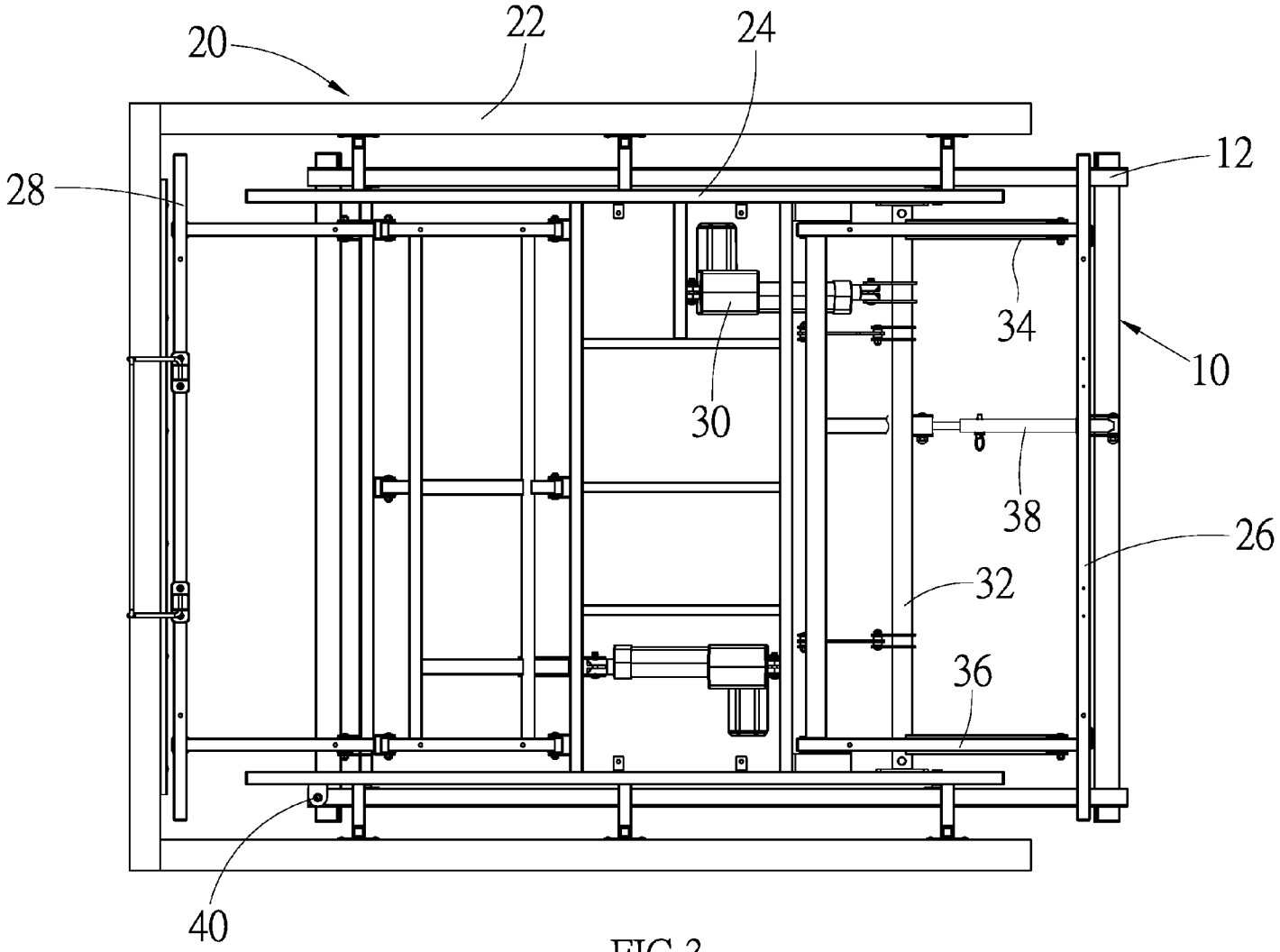
FIG. 3 is a top view of the bed shown in FIG. 2.

Referring to FIGS. 2 and 3, the tracks 12 extend parallel to each other. The mattress-supporting device 20 includes an external frame 22, an internal frame 24, a body-supporting element 26 and a leg-supporting element 28. The internal frame 24 is located within and connected to the external frame 22. The body-supporting element 26 is pivotally connected to an end of the internal frame 24 corresponding to a user's body. The leg-supporting element 28 is pivotally connected to another end of the internal frame 24 corresponding to the user's legs.

The first driving unit includes an extensible element 30, a crankshaft 32, two pivotal elements 34 and 36 and a telescopic element 38. The crankshaft 32 includes a major crank (not numbered), two minor cranks (not numbered). Two ends of the crankshaft 32 are pivotally connected to the internal frame 24. The extensible element 30 is a hydraulic or pneumatic cylinder, a threaded rod used with a nut or another proper element. The extensible element 30 includes an end connected to a portion of the internal frame 24 and another end connected to the major crank of the crankshaft 32. Each of the pivotal elements 34 and 36 includes an end connected to a corresponding one of the minor cranks of the crankshaft 32. The telescopic element 38 includes an end connected to one of the crossbars of the base 10 and another end connected to the body-supporting element 26.

A limiting unit 40 is provided on the internal frame 24 corresponding to one of the tracks 12.

Figure 4:
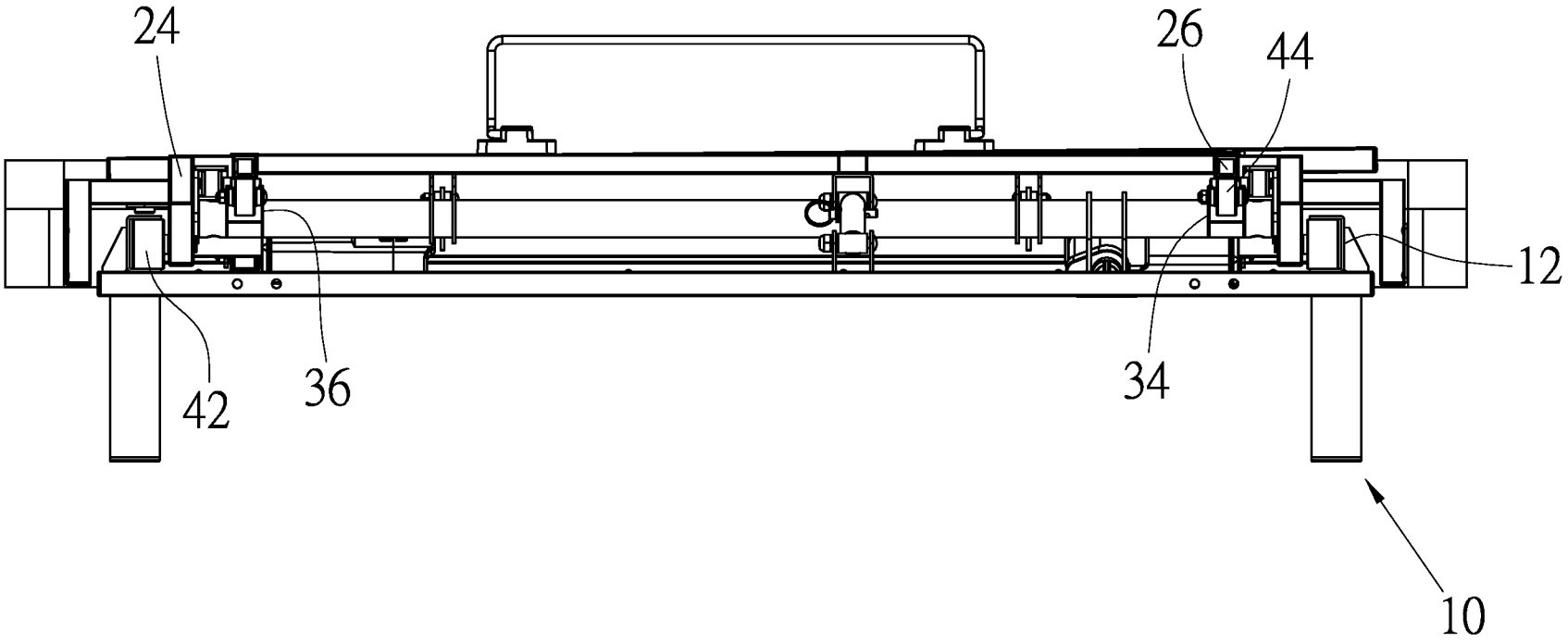
FIG. 4 is a front view of the bed shown in FIG. 2.

Referring to FIG. 4, the internal frame 24 includes two rollers 42 supported on one of the tracks 12 and two other rollers 42 supported on the other track 12. A roller 44 is connected to another end of each of the pivotal elements 34 and 36. The rollers 44 are located against a lower face of the body-supporting element 26.

Figure 5:
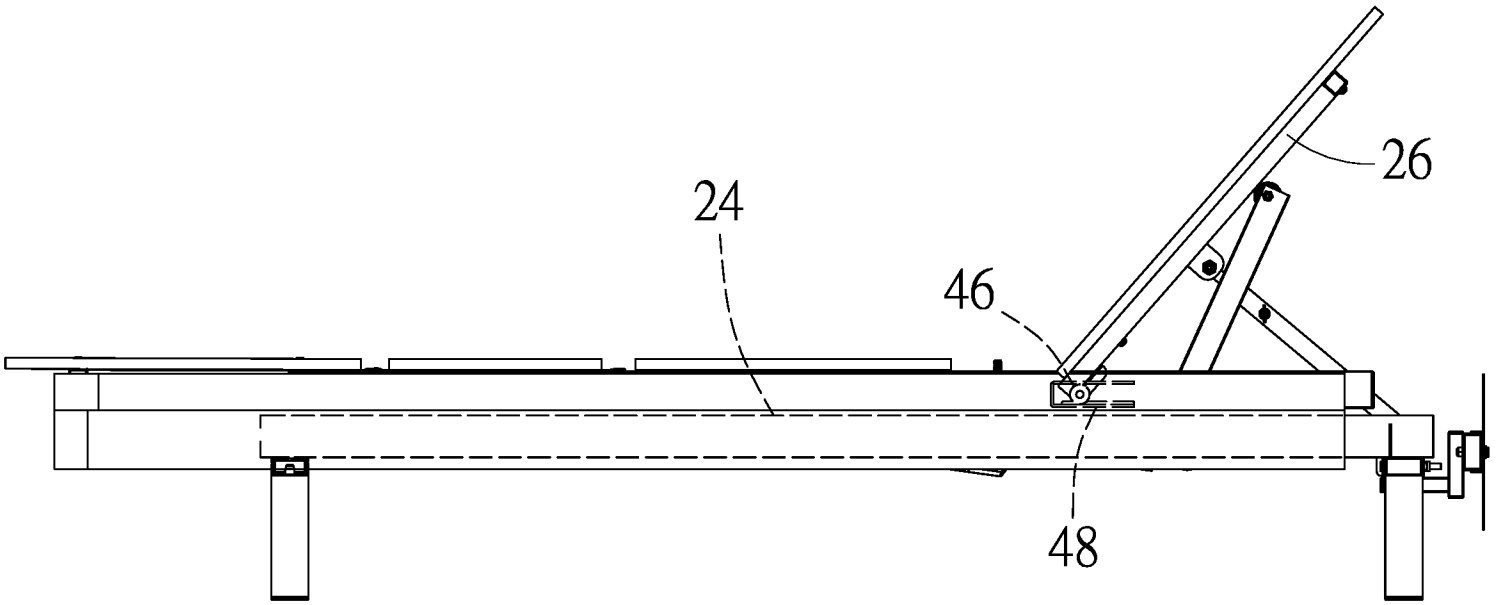
FIG. 5 is a side view of the bed in another position than shown in FIG. 2.

Referring to FIG. 5, the internal frame 24 includes two tracks 48 extending parallel to each other. The body-supporting element 26 includes two rollers 46. Each of the rollers 46 is supported on a corresponding one of the tracks 48. The body-supporting element 26 is movably supported on an end of the internal frame 24.

Figure 6:
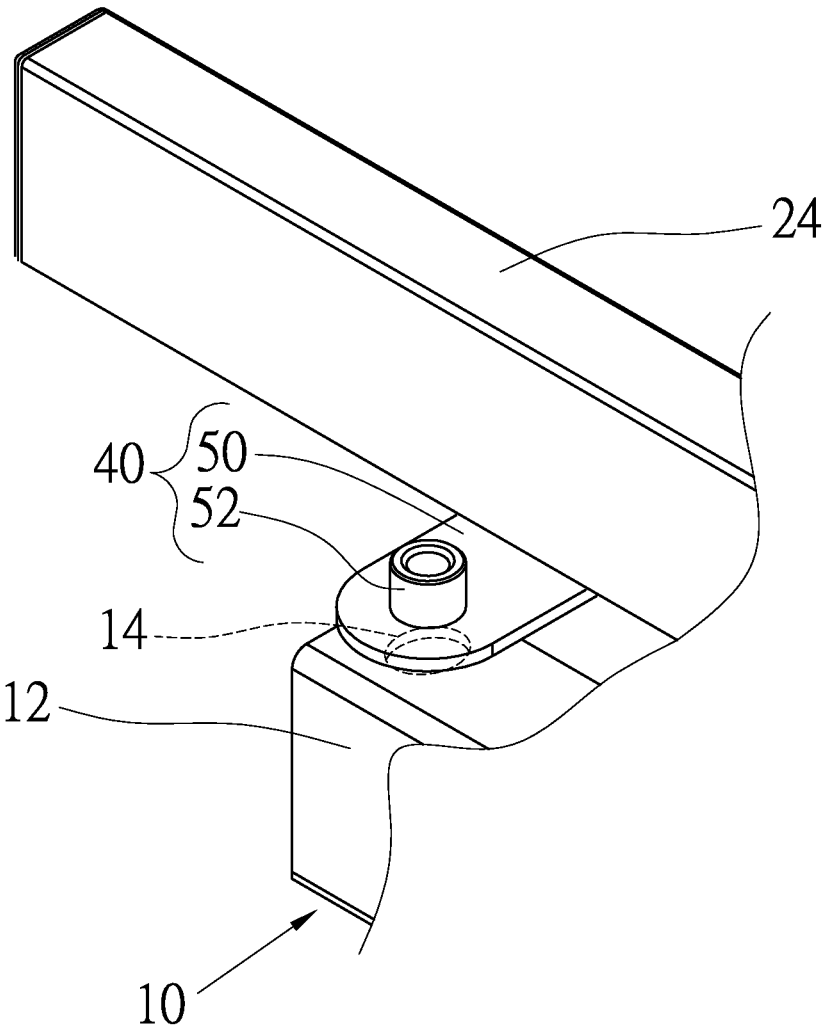
FIG. 6 is an enlarged partial view of the body-supporting unit shown in FIG. 2.
Figure 9:
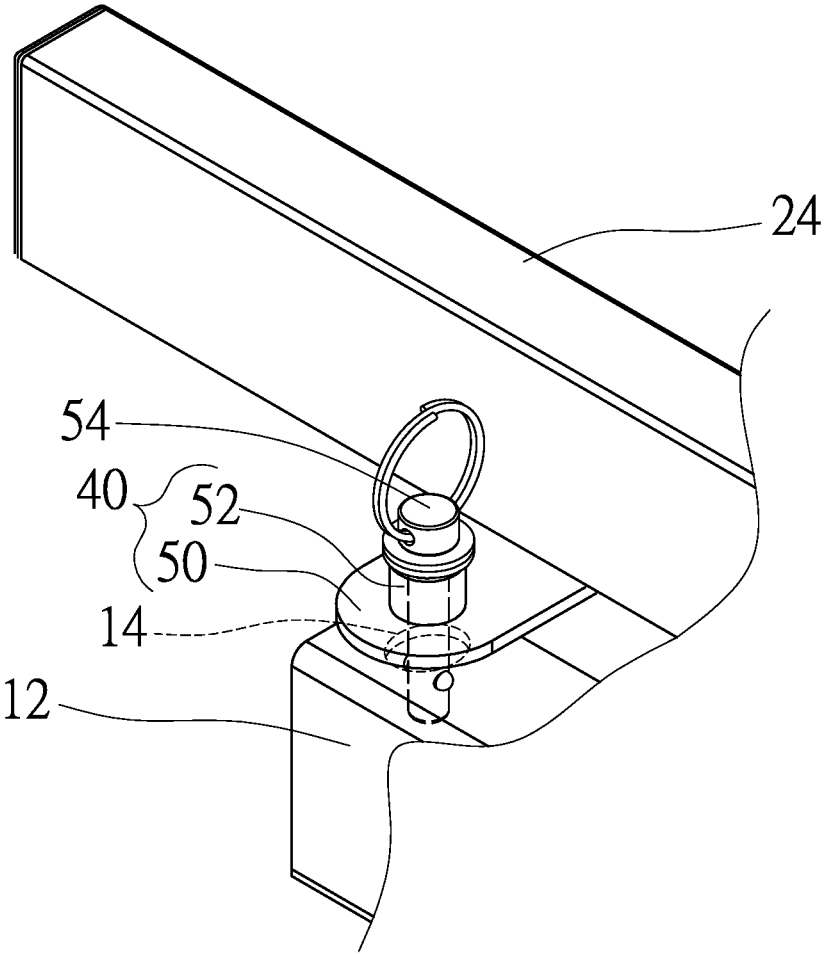
FIG. 9 is another enlarged partial view of the body-supporting unit shown in FIG. 2.

Referring to FIGS. 6 and 9, the limiting unit 40 includes a lug 50, a socket 52, a pin 54 and an aperture 14. The aperture 14 is made in one of the tracks 12 of the base 10. The lug 50 is connected to the internal frame 24 by welding for example. The socket 52 is connected to lug 50 by welding for example. The socket 52 is aligned to the aperture 14.

Figure 7:
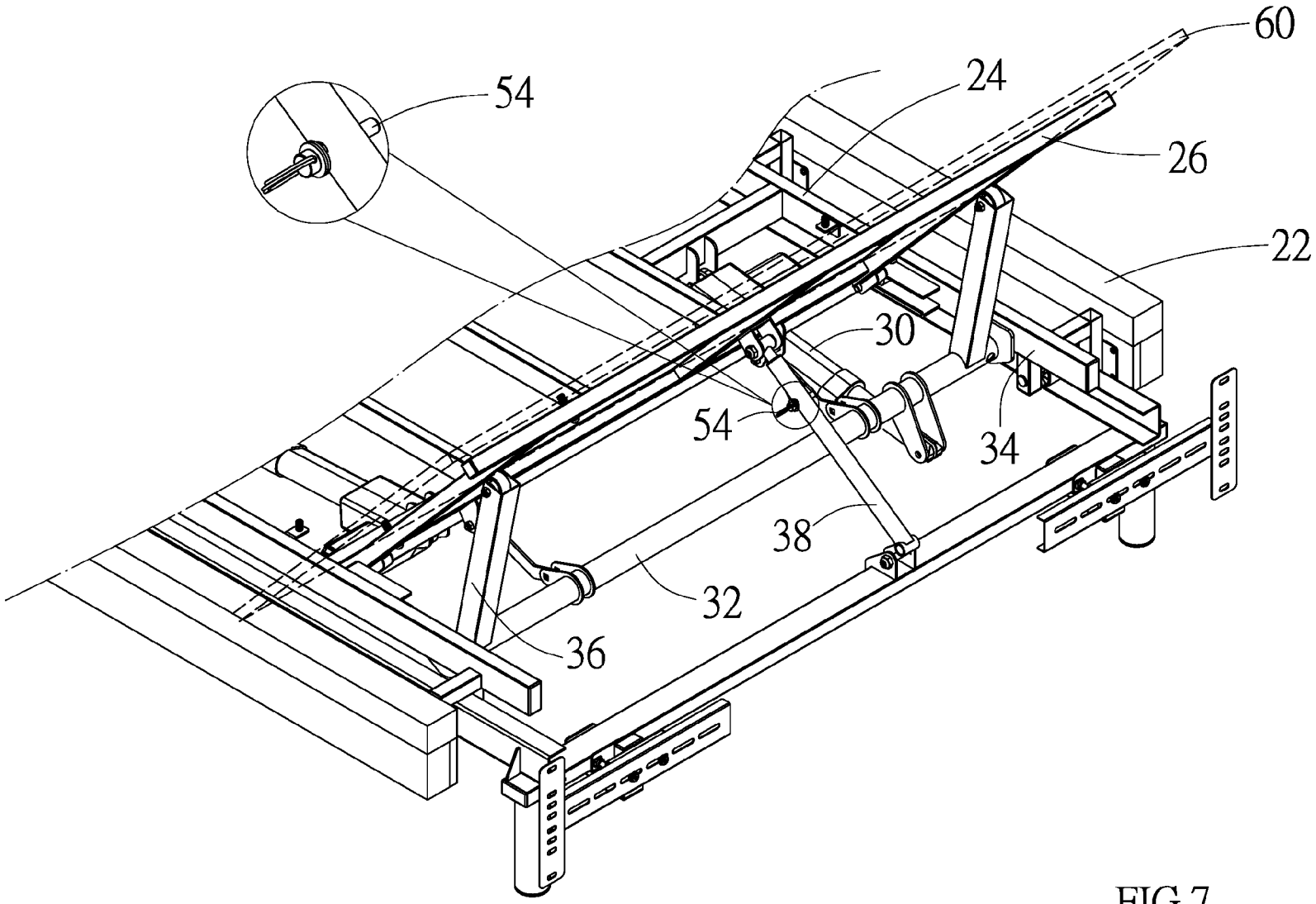
FIG. 7 is an enlarged partial view of a body-supporting unit of the bed shown in FIG. 2.

Referring to FIG. 7, the pin 54 is inserted in an aperture (not numbered) made in the telescopic element 38. Thus, the telescopic element 38 is prevented from extension.

The extensible element 30 rotates the crankshaft 32 to pivot the telescopic element 38 and the body-supporting element 26. As mentioned above, an end of each of the pivotal elements 34 and 36 is located beneath the body-supporting element 26.

The internal frame 24 and the leg-supporting element 28 are moved towards the body-supporting element 26 as the body-supporting element 26 is pivoted because the telescopic element 38 is kept at a certain length. Accordingly, the external frame 22, which is connected to the internal frame 24, is also moved.

Figure 8:
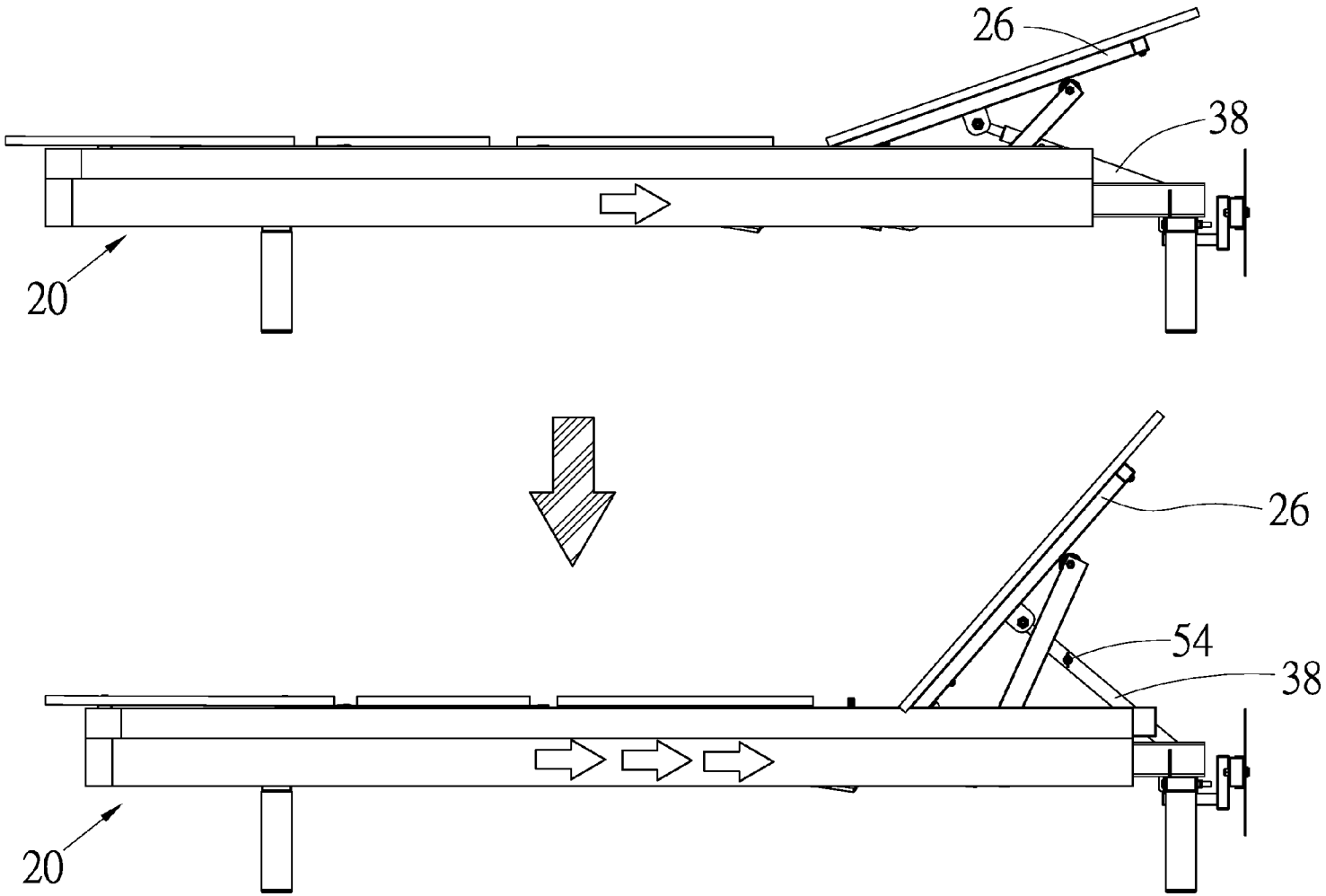
FIG. 8 shows synchronous pivoting and horizontal movement of the body-supporting unit.

Referring to FIG. 8, the pin 54 is inserted in the aperture of the telescopic element 38. The mattress-supporting device 20 is horizontally moved when the body-supporting element 26 is pivoted upwards.

Referring to FIG. 9, the pin 54 is inserted in the aperture 14 of the track 12 via the socket 52. Thus, the internal frame 24 is locked in position, and so is the external frame 22, which is connected to the internal frame 24.

Figure 10:
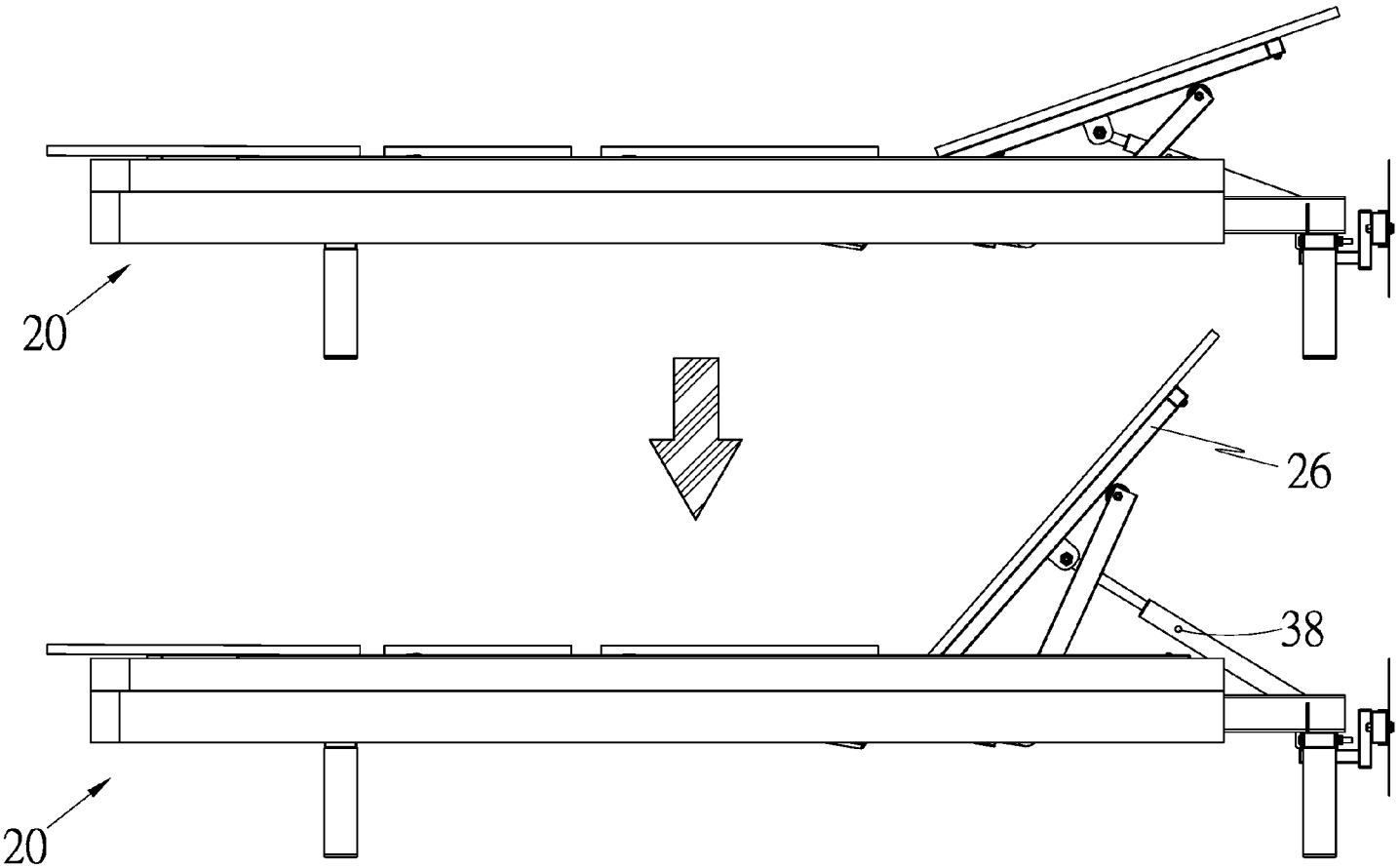
FIG. 10 shows pivoting of the body-supporting unit.

Referring to FIG. 10, the body-supporting element 26 is pivoted upwards as the crankshaft 32 is pivoted by the extensible element 30. The telescopic element 38 is pivoted upwards and extended as the body-supporting element 26 is pivoted upwards. That is, the mattress-supporting device 20 is not horizontally moved and the telescopic element 38 is pivoted upwards and extended as the body-supporting element 26 is pivoted upwards when the pin 54 is inserted in the aperture 14 via the socket 52.

Referring to FIG. 2 again, the bed further includes a second driving unit. The second driving unit includes an extensible element 56. The extensible element 56 includes an end connected to the internal frame 24 and another end connected to the leg-supporting element 28 via a proper linkage. The second driving unit is operable to pivot the leg-supporting element 28.

As discussed above, the pin 54 is selectively inserted in the telescopic element 38 or the limiting unit 40 so that the bed is switched between two modes. In the first mode, the mattress-supporting device 20 is pivoted and horizontally moved as the body-supporting element 26 is pivoted. In the second mode, the mattress-supporting device 20 is pivoted but not horizontally moved as the body-supporting element 26 is pivoted.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A bed comprising:
- a base comprising two tracks;
- a mattress-supporting device comprising:
- a frame comprising rollers supported on the tracks;
- a body-supporting element pivotally connected to an end of the frame; and
- a leg-supporting element pivotally connected to another end of the frame;
- a first driving unit operable for pivoting the body-supporting element and comprising:
  - a crankshaft supported on the frame;
  - an extensible element comprising an end pivotally connected to the frame and another end pivotally connected to the crankshaft;
  - two pivotal elements each comprising an end pivotally connected to the crankshaft and another end pivotally connected to the body-supporting element; and
  - a telescopic element comprising an end connected to the base and another end pivotally connected to the body-supporting unit;
- a second driving unit operable for pivoting the leg-supporting element; and
- a limiting unit movable between a first position to allow horizontal movement of the mattress-supporting device on the base as the body-supporting element is pivoted and a second position to avoid horizontal movement of the mattress-supporting device on the base as the body-supporting element is pivoted, wherein the limiting unit releases the frame from the base and avoids extension of the telescopic element in the first position, wherein the limiting unit locks the frame to the base and allows extension of the telescopic element in the second position.

2. The bed according to claim 1, wherein the frame comprises two tracks, wherein the body-supporting element comprises two rollers supported on the tracks of the frame.

3. The bed according to claim 1, wherein the each of the pivotal elements comprises a roller placed against the body-supporting element.

4. The bed according to claim 1, wherein the limiting unit comprises a pin inserted in the telescopic element in the first position and inserted in the base through the frame in the second position.

5. The bed according to claim 4, wherein the limiting unit further comprises an aperture made in the base, a lug connected to the base, and a socket connected to the lug, wherein the pin is inserted in the aperture through the socket in the second position.

6. The bed according to claim 4, wherein the lug is connected to one of the tracks of the base.

7. The bed according to claim 6, wherein the second driving unit comprises an extensible element formed with an end connected to the internal frame and another end connected to the leg-supporting element.

* * * * *